US006893096B2

(12) United States Patent
Bonn et al.

(10) Patent No.: US 6,893,096 B2
(45) Date of Patent: May 17, 2005

(54) HEADREST SUPPORT AND ADJUSTMENT MECHANISM

(75) Inventors: Brian E. Bonn, Portland, OR (US); Christopher C. Stone, Newberg, OR (US); William R. Stewart, Tigard, OR (US)

(73) Assignee: A-dec, Inc., Newberg, OR (US)

( * ) Notice: Subject to any disclaimer, the term of this patent is extended or adjusted under 35 U.S.C. 154(b) by 0 days.

(21) Appl. No.: 10/236,687

(22) Filed: Sep. 5, 2002

(65) Prior Publication Data

US 2004/0046435 A1 Mar. 11, 2004

(51) Int. Cl.[7] ..... A47C 1/10
(52) U.S. Cl. ..... 297/409; 297/408
(58) Field of Search ..... 297/391, 408, 297/409, 410, 61, 353, 411.36, 374

(56) References Cited

U.S. PATENT DOCUMENTS

| | | | | | |
|---|---|---|---|---|---|
| 955,094 | A | * | 4/1910 | McNeel | |
| 1,597,847 | A | | 8/1926 | Walton | |
| 2,278,080 | A | | 3/1942 | Koenigkramer et al. | |
| 3,135,549 | A | | 6/1964 | Larsson | |
| 3,817,576 | A | * | 6/1974 | Ciavattoni et al. | 297/408 |
| 3,853,350 | A | | 12/1974 | Leffler | |
| 4,062,587 | A | | 12/1977 | Wolters | |
| 4,198,094 | A | | 4/1980 | Bjerknes et al. | |
| 4,266,760 | A | | 5/1981 | Matsui et al. | |
| 4,366,985 | A | | 1/1983 | Leffler | |
| 4,375,902 | A | * | 3/1983 | Tai et al. | 297/408 |
| 4,392,686 | A | | 7/1983 | Beer | |
| 4,636,004 | A | | 1/1987 | Neumüller | |
| 4,693,514 | A | | 9/1987 | Völkle | |
| 4,840,429 | A | * | 6/1989 | Stockl | 297/409 |
| 4,938,531 | A | | 7/1990 | Fogarassy | |
| 5,007,678 | A | * | 4/1991 | DeKraker | 297/353 |
| 5,066,069 | A | | 11/1991 | DeGelder | |
| 5,328,242 | A | | 7/1994 | Steffens et al. | |
| 5,520,441 | A | * | 5/1996 | Citton | 297/440.21 |
| 5,664,841 | A | * | 9/1997 | Dal Monte | 297/408 |
| 6,250,716 | B1 | * | 6/2001 | Clough | 297/408 |
| 6,397,414 | B1 | | 6/2002 | Lloyd | |

FOREIGN PATENT DOCUMENTS

| | | |
|---|---|---|
| EP | 673633 | 9/1995 |
| EP | 1186257 | 3/2002 |

* cited by examiner

*Primary Examiner*—Peter M. Cuomo
*Assistant Examiner*—Stephen Vu
(74) *Attorney, Agent, or Firm*—Klarquist Sparkman, LLP

(57) ABSTRACT

Mechanism for supporting and permitting selected adjustment of the position of a headrest relative to the back of a chair includes an elongate housing, support brackets pivotally connected adjacent opposite ends of the body, and a plurality of interleaved elongate plate members extending longitudinally of the body and movable relative thereto, with opposite ends of the interleaved plate members pivotally connected to the brackets. Clamping mechanism is provided for releasably clamping interleaved portions of the plate members to hold them, and their associated brackets, in selected positions. A slide mechanism mounts a headrest permitting translational movement of the headrest relative to the mechanism.

40 Claims, 2 Drawing Sheets

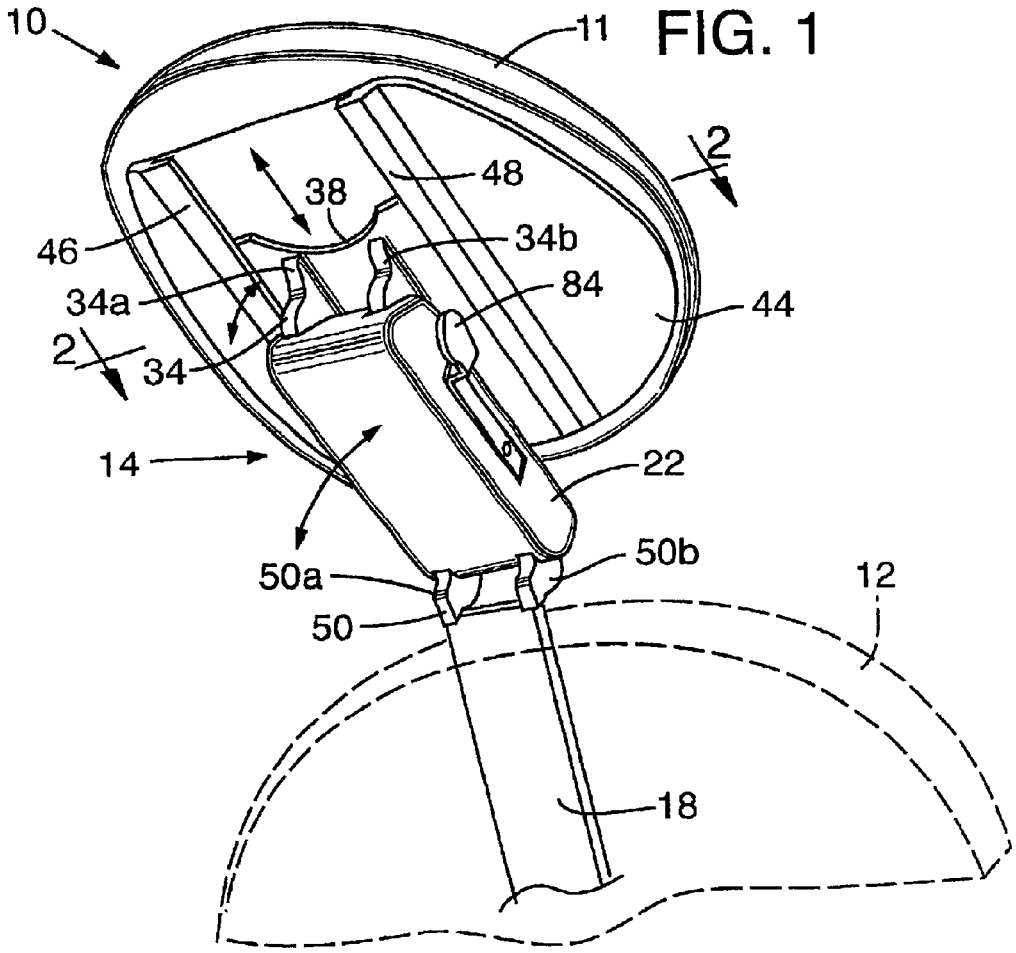
FIG. 1
FIG. 2
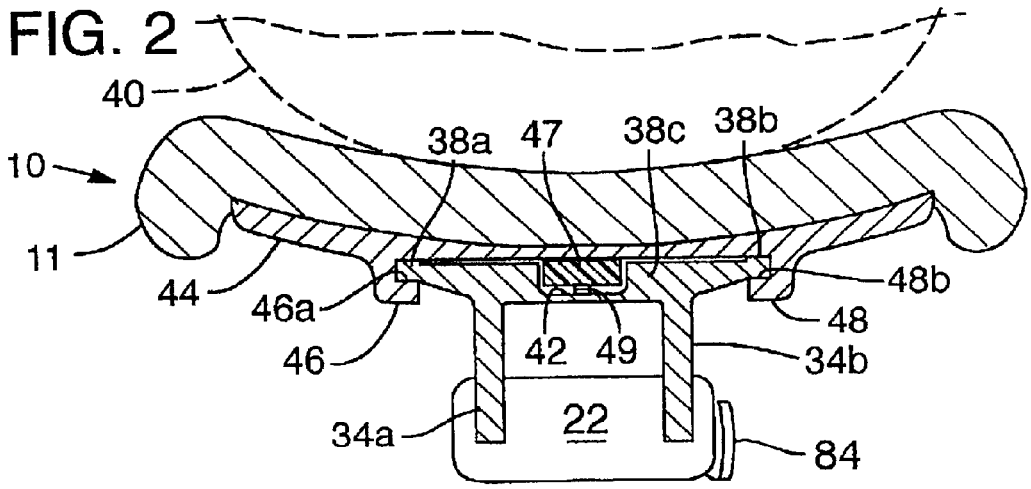

HEADREST SUPPORT AND ADJUSTMENT MECHANISM

FIELD

This invention relates to mechanism for adjustably supporting a headrest relative to a chair back.

BACKGROUND

In many situations, and particularly in medical and dental chair situations, chairs are provided with a back and a headrest which projects above the back. Attempts have been made to produce a comfortable and easily adjusted headrest, but for the most part these have not provided the range of adjustability and ease of use that may be desired.

The headrest often is a somewhat pillow-shaped element spaced from the upper edge of the chair back and needs to be positioned to comfortably cradle the user's head. The comfort and adaptability of the headrest will be determined in great part by its angular position relative to the chair back, its position relative to the plane of the support surface of the chair back, and its distance from the top of the chair back. Each of these may require different positioning due to the characteristics of the user.

Many conventional headrests on chairs, such as dental chairs, are mounted on the chair back through mechanism which provides some degree of adjustability. However, the adjustment may require loosening of a screw-actuated mechanism, adjusting the headrest, and then having to screw the mechanism back to a tightened condition. This often is a two-handed operation and requires more operator time and effort than is desired.

A more desirable mechanism would allow the headrest to be locked in a desired position with the mechanism at rest, be able to be released by a single-hand actuation, with release of the actuator then returning the mechanism to a lock-up condition.

Further, for matters of hygiene, a plastic bag, or other covering, often is placed over the headrest and actuator mechanism making it difficult to access screw actuators or other conventional adjustment mechanism. Thus, a mechanism which permits one-handed adjustment and which may be easily operated through such a covering would be desirable.

Further, it is desirable to have a headrest support and adjustment mechanism which permits at least two degrees of pivotal freedom. Such would allow the mechanism to be pivoted, or rotated, fore-and-aft relative to the chair back, and then have another adjustment permitting pivoting of the headrest itself relative to remainder portions of the mechanism.

In the past, the height adjustment of the headrest above the chair back generally has been permitted only through a major operating stem which is slidable relative to the chair back and then frictionally held in position. There has been little opportunity for minor adjustment of the height of the headrest once the stem is held in place. A need is apparent for some auxiliary slide mechanism allowing simple raising and lowering of the headrest relative to the chair back which may be accomplished either by the operator or the patient/user of the chair.

Additionally, it has been found that many headrests and headrest adjustment mechanisms are so thick, when measured front-to-back, that when the chair, headrest and patient are laid back to a nearly horizontal position, with the patient's head preferably as close to the operator's (dentist or hygienist) lap as possible, the patient's head still is elevated some distance above the operator's lap. This can produce an inconvenient working position for the operator, requiring that their hands and wrists be placed in undesirable positions. It has been found that the lower the patient's head may be relative to the operator's lap, the more desirable the angle for the operator's hands and wrists. Thus, a thinner mechanism and headrest are desirable to allow such.

Thus it is desirable to provide headrest adjustment mechanism which can be worked through a covering bag, is easy to clean, is simple to operate, is reduced to as small a package as possible to provide good positioning of the patient for the operator to work on, and is operated with a single hand operated manual actuator which requires a minimal amount of force to release the headrest from a lock up position to permit adjustment, yet when the actuator is released positive locking for the headrest in a desired orientation is provided.

SUMMARY

The present invention is structured and operates to overcome many of the disadvantages set out above found in previous devices and to provide the desired characteristics described.

More specifically, mechanism is provided having an elongate mounting body with brackets pivotally connected adjacent its opposite ends for mounting to a headrest and to a chair back, with a plurality of elongate interleaved plate members, or fingers, pivotally connected to the brackets with a clamp-style locking mechanism releasably holding the interleaved fingers in frictional locked positions to secure the brackets in selected positions. Release mechanism is provided for temporarily releasing the clamping force to permit pivotal movement of the brackets relative to the mounting body to permit adjustment of the headrest relative to the chair back.

In one embodiment of the mechanism, a mounting body is a substantially enclosed housing and two sets of plate members, or friction plates, extend longitudinally of the housing with interleaved portions of the two sets of plate members situated within the enclosure. The plate members extend and move longitudinally of the housing. This provides a relatively thin assembly which permits a patient's head supported by the chair back and headrest to be positioned closely adjacent an operator's lap during use.

In the mechanism, a release mechanism operator in one embodiment includes an elongate lever pivotally mounted to provide adequate mechanical advantage for release of clamping force on the friction plates through one-handed use. This permits a user to easily release the locking mechanism holding the pivotal brackets in place to permit adjustment, and then release of the lever allows locking to recur.

Another aspect is the provision of a slide mechanism adapted to mount the headrest on the adjustment assembly, such that the headrest may be moved in a translational path toward and away from the back of the chair. This permits comfortable placement of the headrest for both tall and short patients.

The structure of the headrest support is such that the translational movement is accomplished in a sliding fashion by either the operator or patient to permit convenient and comfortable positioning of the headrest relative to the pivotal adjustment mechanism and the backrest.

In one embodiment slide mechanism mounts the headrest for translational movement relative to ancillary headrest support mechanism, such that the headrest may be moved to a position in which majority of the headrest extends beyond the ancillary support mechanism. In this position only the thickness of the headrest cushion and slide mechanism separate the patient's head from the operator's lap to permit optimum working position.

These and other features will become more apparent as the following description is read in conjunction with the drawings.

BRIEF DESCRIPTION OF THE DRAWINGS

FIG. 1 is a rear perspective view of a headrest support according to an embodiment in the invention, illustrated in conjunction with a back of a chair (in dashed line).

FIG. 2 is an enlarged cross-sectional view taken generally along the line 2—2 in FIG. 1.

DESCRIPTION OF EMBODIMENT

Figure 3:
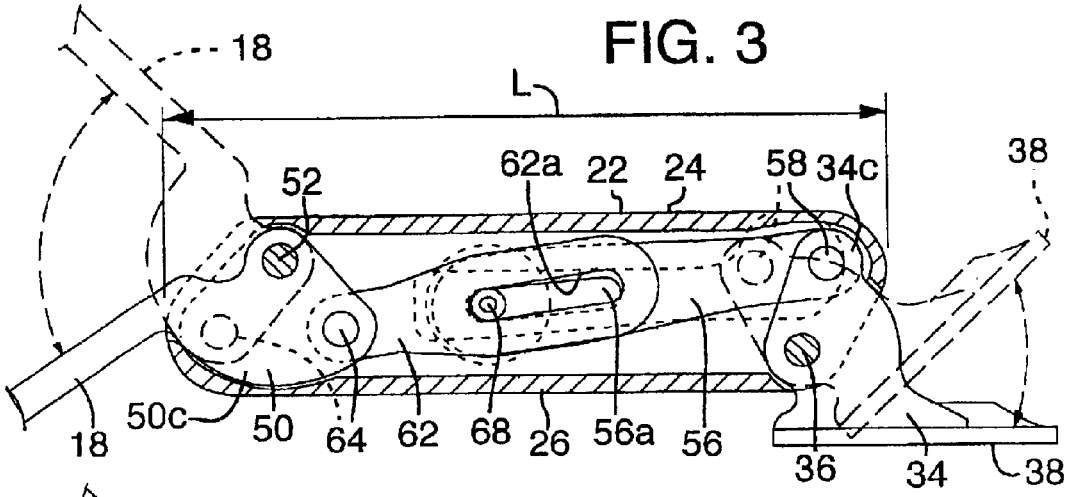
FIG. 3 is a cross-sectional view of a pivotally adjustable support mechanism portion of the headrest support, with mounting brackets at opposite ends thereof shown in first positions in solid outline and in second positions in dashed outline.

Referring to the drawings, and first more specifically to FIG. 1, at 10 as indicated generally a headrest with a cushion 11 supported above a chair back 12 such as would be used in a dental or other medical style chair to support a patient. The headrest is supported above the chair back 12 by adjustment and support mechanism indicated generally at 14 constructed according to an embodiment of the invention.

An elongate slide post, or bar, 18 would be attached to the back of chair 12 by a frictional holding mechanism which allows major raising and lowering of the headrest mechanism. This allows approximate positioning of the headrest but is inconvenient for finer adjustment once the patient is in the chair.

Figure 4:
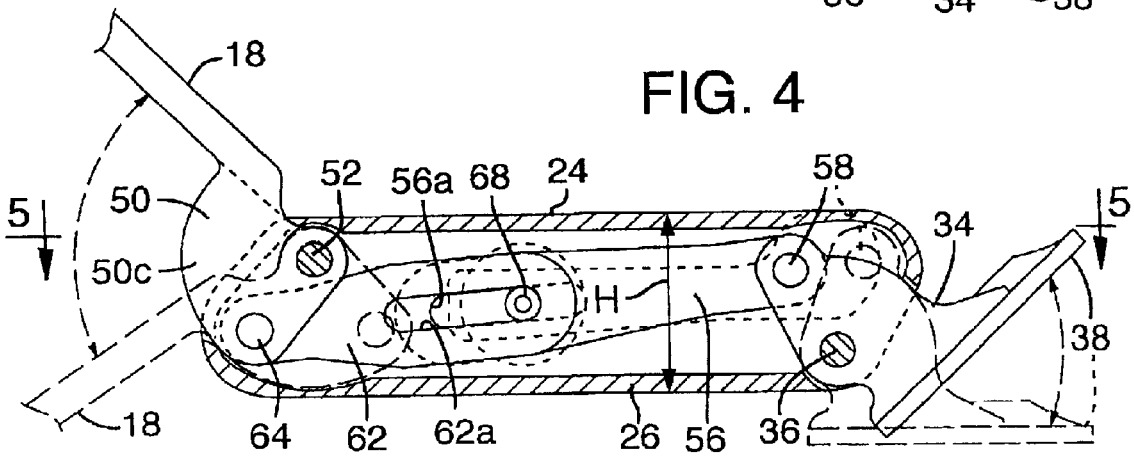
FIG. 4 is a view similar to FIG. 3 with the operating elements therein in reversed operating positions.
Figure 5:
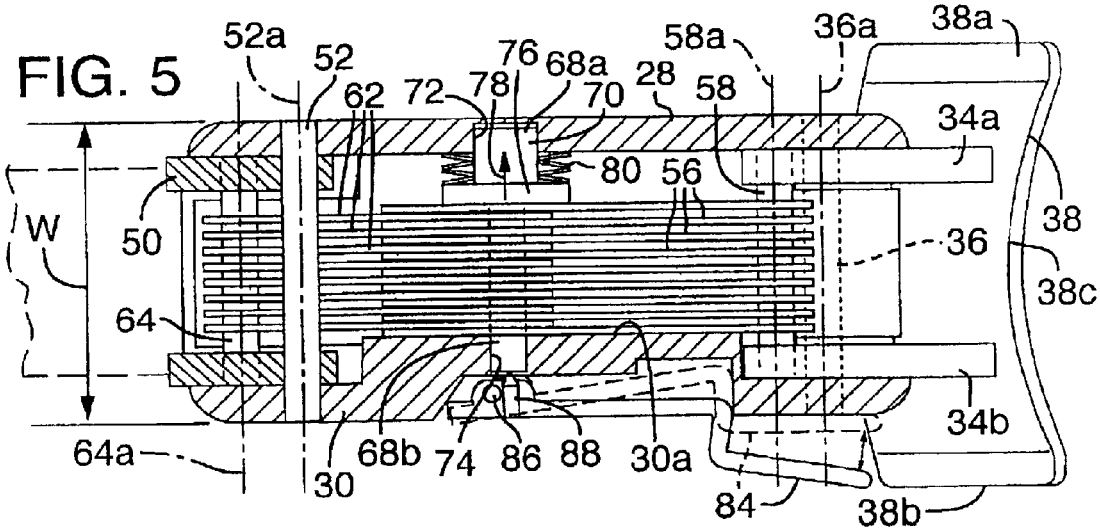
FIG. 5 is a cross-sectional view taken generally along the line 5—5 in FIG. 4.

The adjustment and support mechanism 14 for the headrest according to the invention includes an elongate housing, or mounting body, 22. Referring to FIGS. 3–5, the housing has a selected length L, a selected height H, and a selected width W which are best adapted to provide the operational advantages of the present device. For example, the width W is greater than height H so that appropriate operating mechanism may be accommodated within the housing while still providing a low profile height H to allow patient's head on the headrest to be placed as close to the operator's lap as possible. The support mechanism 14 is show in FIGS. 3–5 in a substantially horizontal orientation which it may assume when a patient is laid back in the chair.

The housing 22 has a substantially planar top wall 24, a substantially planar bottom wall 26, spaced therefrom, and a pair of opposed spaced apart side walls 28,30. The top, bottom and side walls define an enclosure which houses the major portion of the operating components of the apparatus.

A headrest mounting bracket 34 having a pair of bracket arms 34*a*, 34*b* is pivotally connected through pivot connection, or rod, 36 adjacent one end of housing, or body, 22. Pivot connection 36 is spaced outwardly from a central region of housing 22 toward said one end. Pivot connection 36 has an axis 36*a* which extends laterally, or widthwise, of housing 22. Headrest bracket 34 also has a lever arm portion 34*c* thereon which extends laterally from pivot connection 36.

A crossplate, or guide plate, 38 extends across outer edge portions of bracket arms 34*a*, 34*b* and is secured, as by welding, thereto or is cast as a single element with bracket arms 34*a*, 34*b*. The crossplate has opposed outer edge, or margin, portions 38*a*,38*b* which project laterally outwardly beyond bracket arms 34*a*,34*b* and a central portion 38C as best seen in FIGS. 2 and 5.

As best seen in FIG. 2, cushion 11 of headrest 10 may have a shallow curved configuration to comfortably cradle a patient's head, indicated generally at 40 in dashed line in FIG. 2. A connector plate, or member, 44 may be secured to the back of cushion 11 and, as best seen in FIG. 2, and has a shallow curved configuration which conforms to, or is complementary to, the curved configuration of cushion 11. Connector plate 44 has laterally spaced apart parallel guide rail portions 46,48 extending longitudinally of the connector plate and forming channels, or guideways, 46*a*, 48*b* adapted to slidably receive edge margin portions 38*a*, 38*b*, respectively, of crossplate 38 therein. Channels 46*a*, 48*b* act as guideways to mount connector plate 44 on headrest bracket 34 and permit translational sliding movement relative thereto. Explaining further, a sliding fit is provided between edge margins 38*a*, 38*b* and channels 46*a*, 48*b* permitting the headrest connector plate 44 and the headrest cushion connected thereto to be slid along crossplate 38 toward and away from chair back 12.

To improve the operation of this translational sliding movement, appropriate materials may be interposed between edge margin portions 38*a*,38*b* and channels 46*a*, 48*a* to provide a selected sliding fit therebetween. The fit should be such that an operator or patient may easily slide the headrest up or down to produce the most convenient or comfortable position desired. A layer of a material such as DELRIN (produced by EI Dupont De Nemours) has been found to work well as an interface in the channels between edge margin portions 38*a*,38*b* and channels 46*a*,48*a*. This, or other material appropriate to provide the desired sliding fit, may be applied either to edge margin portions 38*a*,38*b* or to the interiors of channels 46*a*,48*a*.

Referring still to FIG. 2, a cavity 42 is formed in central section 38*c* of crossplate 38 facing toward connector plate 44. A friction plate 47, which may be in the form of a block of NYLATRON (produced by Polymer Corporation) is situated in cavity 42 with a spring 49 biasing it outwardly toward connector plate 44. The biasing force of spring 49 urging friction plate 47 outwardly and against connector plate 44 serves to produce a selected frictional holding of the connector plate relative to the crossplate such that the headrest cushion will be held in a selected position once it is placed as desired by the user.

A back support bracket 50 to which post 18 is secured, as by welding or other means, is pivotally connected to housing 22 through a pivot connection, or rod, 52 adjacent the end of housing 22 opposite bracket 34. Pivot connection 52 is spaced outwardly from a central region of housing 22 toward said opposite end. The pivot connection 52 has an axis 52*a* which extends laterally, or widthwise, of housing 22.

Bracket 50 includes a pair of laterally spaced bracket arms 50*a*,50*b*. Bracket arms 50*a*,50*b* project outwardly from their associated end of housing 22 through openings defined in housing 22, as do bracket arms 34*c*,34*b*, at the opposite end of the housing. Bracket 50 has a lever arm portion indicated generally at 50*c* which projects laterally of pivot connection 52.

A plurality of elongate substantially planar parallel plate members, or fingers, also referred to herein as friction plates, 56 are disposed in a set. They are pivotally connected adjacent their outer set of ends at a pivot connection 58, or rod, 58 to lever arm 34*c* of bracket 34. The axis 58*a* of the pivot connection extends transversely, or widthwise, of housing 22. Remainder portions of plate members 56 extend longitudinally through a major portion of the interior of the enclosure provided by housing 22 toward the opposite end of the housing.

Elongate slots 56*a* are formed in plates 56 extending longitudinally thereof. These slots extend toward the opposite, or inner, ends of plates 56 spaced from the end portion connected to pivot connection 58. Plate members 56 and their respective slots 56*a* are aligned transversely, or widthwise, of housing 22.

A plurality of elongate parallel substantially planar plate members, or fingers, also referred to as friction plates, 62 are disposed in a set with their outer ends pivotally connected at a pivot connection, or rod, 64 extending transversely, or widthwise, of housing 22. The axis 64*a* of pivot connection 64 extends transversely, or widthwise, of housing 22. Plates 62 are connected to lever arm 50*c* in a region spaced from pivot connection 52 for bracket 50.

Remainder portions of plate members 62 extend longitudinally through the enclosure of housing 22 toward the end occupied by bracket 34. Plate members 62 have elongate longitudinally extending slots 62*a* formed therein which extend to a region adjacent their inner ends. Plate members 62 and their respective slots 62*a* are aligned transversely, or widthwise, of housing 22.

As best seen in FIG. 5, the inner end portions of the sets of plate members, fingers, 56 and 62 are interleaved in a mid-region of housing 22.

In the interleaved region portions of slots 56*a*,62*a* are aligned. An elongate rod portion 68 of a locking, or clamping, mechanism indicated generally at 70, extends laterally and slidably through aligned portions of slots 56*a*,62*a*. Rod portion 68 assists in maintaining alignment of the plate members as they move within the housing. Rod 68 has an enlarged cylindrical head portion 68*a* received in a cavity 72 formed in side wall 28. The opposite end portion 68*b* of rod 68 extends into a throughbore 74 in side wall 30.

An enlarged bearing member, or portion, 76 secured to rod 68 is mounted for reciprocating movement in the direction of arrow 78 and is positioned to bear against a laterally outwardly facing side of one of the plate members. In FIG. 5, it bears against an outer facing surface of a plate member 56. Rod 68 and member 76 are held against movement longitudinally of housing 22.

A plurality of stacked spring washers, or Bellville springs, indicated generally at 80 are interposed between side wall 28 of the housing and bearing member 76. These urge the bearing member away from wall 28 and into forceful bearing contact with the plate members. This forces the interleaved portions of the plate members into clamping engagement between bearing member 76 and the inner, or abutment, surface 30*a* of side wall 30. The forceful clamping of bearing member 76 against the interleaved portions of fingers 56,62 clamps them into frictional locking engagement such that they are held in the position shown. Since the outer end portions of the plate members 56,62 are connected to bracket members 34,50, this frictional locking will hold the brackets in their given positions, thus holding the adjustment mechanism in position relative to slide bar support 18 and holding headrest 10 in selected angular position relative to housing 22.

Release mechanism including a lever 84 is provided to release the frictional clamping force and allow the plate members, or fingers, to move longitudinally relative to the housing and relative to each other to permit rotation of and changing of the angularity of brackets 34 and 50 relative to housing 22.

The elongate lever 84 is pivotally connected at 86 to housing 22 and has an engaging projection 88 thereon closely adjacent pivot connection 86. When the lever is in the position illustrated in solid outline in FIG. 5, it has substantially no effect on the clamping mechanism and thus the clamping mechanism frictionally locks the plate members in position. Swinging of the lever member to the dashed outline position illustrated in FIG. 5, causes projection 88 to engage end portion 68*b* of rod 68 and force the rod and bearing member 76 away from clamping engagement with the plate members against the biasing force of springs 80. When the clamping force is thus released by swinging movement of the lever, the plate members are released allowing relative sliding movement therebetween. This permits rotational swinging of bracket 34 and bracket 50 relative to housing 22 to change the angular position of headrest 10. Release of lever 84 returns the mechanism to its locked up position.

The range of pivotal movement of brackets 34,50 and the commensurate longitudinal shifting of their associated fingers 56,62, respectively, are illustrated in FIGS. 3 and 4.

Explaining operation of the apparatus, the operator initially places headrest slide support, or rod, 18 in a selected position relative to the back rest. When a patient, or user, enters the chair, the operator may depress lever 84 easily with one-handed operation due to its significant mechanical advantage provided by the long lever arm to release the clamping lock of the fingers. With the clamping lock thus released, the angular positions of portions of the assembly may be easily adjusted to conform to the patient. Release of the lever returns the mechanism to a locked position.

When the user, or patient, is seated in the chair their back rests against the plane of the user-engaging surface of the chair back. When the clamping mechanism is released, housing 22 may be swung rearwardly or forwardly about its pivot axis 52 to swing the headrest relative to the plane of the user-engaging surface of the chair back. At the same time, the angle of head rest support bracket 34 may be swung about its pivot axis 36 to a selected angular position relative to housing 22. This is all permitted by longitudinal movement of plate members 56,62 within the housing when the clamping mechanism is released. In this way, the headrest may be positioned as desired for the most comfortable disposition for the user and convenient positioning for the operator.

Similarly, once the patient is situated, the slide mechanism connected to the back of the headrest allows the headrest to be easily slid up and down relative to the chair back to obtain desired vertical positioning.

The configuration of housing 22 and the operating mechanism mounted therein for permitting adjustment of the headrest and locking such in a selected position, has a relatively thin profile, or height H, allowing the patient's head to be placed closely adjacent the operator's lap. Further, the enclosed housing provides a protective casing for the operating mechanism which permits ease of operation, cleaning, and positioning.

While a preferred embodiment has been described herein, it should be apparent to those skilled in the art that variations and modifications are possible without departing from the spirit of the invention.

We claim:

1. A mechanism for supporting and permitting selected adjustment of the position of a headrest relative to a back of a chair, the mechanism comprising an elongate mounting body, a first bracket to which a headrest may be connected, said first bracket being pivotally connected at a first pivot adjacent one end of said body, a second bracket for connecting to the chair back, said second bracket being pivotally connected at a second pivot adjacent an end of said body opposite said one end, a plurality of elongate parallel first plate members pivotally connected adjacent one set of their ends to said first bracket at a third pivot in a region spaced from said first pivot, said first plate members extending longitudinally of said body toward the opposite end of said body, said first plate members having elongate longitudinally extending first slots formed therein spaced from said third pivot, a plurality of elongate parallel second plate members pivotally connected adjacent one set of their ends to said second bracket at a fourth pivot in a region spaced from said second pivot, said second plate members extending longitudinally of said body toward said one end of the body, said second plate members having elongate longitudinally extending second slots formed therein spaced from said fourth pivot, said second plate members being interleaved with said first plate members in a region intermediate opposite ends of said body, with portions of said first and second slots aligned, a plate abutment adjacent one side of said body, an elongate locking member extending transversely of said body and slidably through aligned portions of said first and second slots, said locking member having a bearing portion thereon positioned to engage a plate member on the side of said interleaved portions of said first and second plate members opposite said abutment, biasing means urging said bearing portion toward said abutment to clamp said first and second plate members into a locking engagement to secure said first and second brackets against rotation about said first and second pivots, and a release mechanism manually operable to shift said bearing portion in a direction away from said abutment to permit relative sliding movement between said first plate members and said second plate members to adjust the angular positions of the first and second brackets relative to the body.

2. The mechanism of claim 1, wherein said locking member is secured against movement longitudinally of said body and said first plate members are mounted for longitudinal movement relative to said locking member independently of said second plate members.

3. The mechanism of claim 1, wherein said first and second pivots have pivot axes which are parallel to each other.

4. The mechanism of claim 1, wherein said first, second, third and fourth pivots have pivot axes which are parallel to each other.

5. The mechanism of claim 4, wherein said locking member has a longitudinal axis which is parallel to said pivot axes.

6. The mechanism of claim 1, wherein said locking member and bearing portion are movable laterally of the body between locking and release positions, and said biasing means comprises a spring urging said locking member toward said locking position.

7. The mechanism of claim 6, wherein said spring comprises a spring washer interposed between a side of said body and said locking member.

8. The mechanism of claim 7, wherein said spring washer is a Bellville washer.

9. The mechanism of claim 1, wherein said release mechanism comprises an elongate lever pivotally connected to said body at a lever pivot in a region adjacent said locking member and having an operating portion positioned to engage said locking member to move said bearing portion in a direction away from said abutment when the lever is swung in one direction about said lever pivot.

10. The mechanism of claim 9, wherein said lever has a user-engaging portion spaced from said lever pivot a first distance which is a multiple of the distance between said lever pivot and said operating portion.

11. The mechanism of claim 1, wherein said first plate members and said first slots are aligned transversely of said first plate members.

12. The mechanism of claim 1, wherein said second plate members and said second slots are aligned transversely of said second plate members.

13. The mechanism of claim 1, wherein said body comprises an elongate housing having opposed spaced apart top and bottom walls and spaced apart opposed side walls defining an enclosure, said housing having a selected width and height, with the width greater than the height, and said first and second plate members are enclosed in said housing.

14. A mechanism for supporting a headrest relative to a back of a chair and permitting selected adjustment of the position of the headrest relative to the back, the mechanism comprising an elongate mounting body, a first bracket to which a headrest may be connected, said first bracket being pivotally connected at a first pivot adjacent one end of said body and having a first lever arm portion extending laterally of the first pivot, a second bracket for connecting to the chair back, said second bracket being pivotally connected at a second pivot adjacent the end of said body opposite said one end and having a second lever arm portion extending laterally of the second pivot, a set of elongate parallel first plate members pivotally connected at a third pivot adjacent one set of their ends to said first lever arm in a region spaced from said first pivot, said first plate members extending longitudinally of said body toward the opposite end of said body, said first members having first elongate longitudinally extending slots formed therein spaced longitudinally of said first plate members from said third pivot, a set of elongate parallel second plate members pivotally connected at a fourth pivot adjacent one set of their ends to said second lever arm in a region spaced from said second pivot, said second plate members extending longitudinally of said body toward said one end of the body, said second members having elongate longitudinally extending second slots formed therein spaced longitudinally of said second plate members from said fourth pivot, slotted portions of said second plate members being interleaved with said slotted portions of said first plate members in a region intermediate opposite ends of said body, an elongate alignment member extending transversely of said body and slidably through aligned portions of said first and second slots in said plate members, a clamping mechanism operable to clamp said interleaved portions of said first and second plate members into frictional locking contact to hold the plate members against movement relative to each other to hold said first and second brackets in selected angular positions relative to said body, and a release mechanism manually operable to temporarily release said clamping mechanism to permit relative sliding movement between said first plate members and said second plate members to permit adjustment of the angular positions of said first and second brackets relative to said body.

15. The mechanism of claim 14, wherein said clamping mechanism comprises a bearing portion thereon positioned to engage a plate member adjacent one side of a set of the interleaved plate portions and biasing means urging the bearing portion toward said plate members.

16. The mechanism of claim 15, wherein said biasing means comprises a spring.

17. The mechanism of claim 14, wherein said clamping mechanism is secured against movement longitudinally of said body to restrict movement of said plate members relative to said body when said clamping mechanism clamps said interleaved portions of said first and second plate members into frictional locking contact.

18. The mechanism of claim 14, wherein said first pivot, second pivot, third pivot, and fourth pivot are parallel to each other and extend laterally of said body.

19. A mechanism for supporting and permitting selected adjustment of a headrest relative to a back of a chair, the mechanism comprising an elongate mounting body, a set of elongate parallel first plate members extending and movable longitudinally of said body, said first plate members having longitudinally extending first slots formed therein, said first plate members and first slots being aligned transversely of said set of elongate parallel first plate members, a set of elongate parallel second plate members extending and movable longitudinally of said body, said second plate members having longitudinally extending second slots formed therein, said second plate members and second slots being aligned transversely of said set of elongate parallel second plate members, portions of said second plate members being interleaved with portions of said first plate members in regions of said first and second slots, and portions of said first slots aligned with portions of said second slots, a first bracket to which a headrest may be connected pivotally connected at a first pivot to one end of said body, with outer end portions of said first plate members pivotally connected to said first bracket in a region spaced from said first pivot, a second bracket for connecting to said chair back pivotally connected at a second pivot to the end of the body opposite said one end, with outer end portions of said second plate members pivotally connected to said second bracket in a region spaced from said second pivot, an elongate rod extending transversely of said plate members slidably through said aligned portions of said first and second slots, a bearing member positioned to engage a plate member at one side of a set of plate members, a spring urging said bearing member in one direction whereby said bearing member forces said interleaved portions of said first and second plate members into frictional locking engagement to hold said first and second brackets in selected positions relative to said body, and a release mechanism manually operable for shifting said bearing member in a direction opposite said one direction to permit sliding movement of said plate members relative to said body to permit angular adjustment of the first and second brackets relative to said body.

20. A mechanism for supporting and permitting adjustment of the position of a headrest relative to a back of a chair, the mechanism comprising a housing having opposed ends, a central region between said opposed ends, opposed spaced apart top and bottom walls and spaced apart opposed side walls defining an enclosure, said housing having a selected width and height, a headrest support bracket pivotally connected at a first pivot spaced outwardly from a central region of said housing toward one end of said housing, with the axis of said first pivot extending widthwise of said housing, and a first lever arm extending laterally of said first pivot axis, a back support bracket pivotally connected at a second pivot spaced outwardly from a central region of said housing toward an end of said housing opposite said one end, with the axis of said second pivot extending widthwise of said housing, and a second lever arm extending laterally of said second pivot axis, a set of parallel first plate members pivotally connected adjacent one set of their ends to said first lever arm at a third pivot in a region spaced from said first pivot, said first plate members extending toward the opposite end of the housing and movable longitudinally in said enclosure, a set of parallel second plate members pivotally connected adjacent one set of their ends to said second lever arm at a fourth pivot in a region spaced from said second pivot, said second plate members extending toward said one end of the body and movable longitudinally in said enclosure, with portions of said second plate members being interleaved with portions of said first plate members in said central region, a clamping mechanism operable to clamp said interleaved portions of said first and second plate members into locking frictional contact to hold them against movement relative to each other to hold said headrest and back support brackets in selected angular positions relative to the housing, and a release mechanism manually operable to release said clamping action of said clamping mechanism to release said first and second plate members to permit longitudinal movement of said sets of first and second plate members relative to each other and pivotal movement of said headrest and back support brackets relative to said housing.

21. The mechanism of claim 20, which further comprises means for maintaining selected alignment of said first and second plate members during movement thereof in said enclosure.

22. The mechanism of claim 20, wherein said first plate members have elongate longitudinally extending first slots formed therein spaced from said third pivot, said second plate members have elongate longitudinally extending second slots formed therein spaced from said fourth pivot, and portions of said first and second slots are aligned laterally of the plate members.

23. The mechanism of claim 22, wherein said clamping mechanism comprises an elongate locking member extending widthwise of said housing slidably through said aligned portions of said first and second slots.

24. The mechanism of claim 23, wherein said locking member has a bearing portion thereon positioned to engage a plate member at one side of a set of plates and yieldable biasing means operable to urge the bearing portion in one direction to press the engaged plate member into engagement with other interleaved plate members.

25. The mechanism of claim 24, wherein said release mechanism comprises an elongate lever pivotally connected to said body at a lever pivot in a region adjacent said locking member and having an operating portion positioned to engage said locking member to move said bearing portion in a direction away from said plate members when the lever is manually swung in one direction about said lever pivot.

26. The mechanism of claim 25, wherein said lever has a user-engaging portion spaced from said lever pivot a first distance which is a multiple of the distance between said lever pivot and said operating portion.

27. The mechanism of claim 20, wherein said first and second plate members and said first and second lever arms are housed in said enclosure.

28. The mechanism of claim 20, wherein said top and bottom walls are substantially planar over a majority of their lengths and are disposed parallel to each other.

29. The mechanism of claim 20, wherein a bracket comprises a pair of parallel laterally spaced bracket arms and said housing has opposed end walls having spaced openings therein through which said bracket arms extend.

30. The mechanism of claim 20, wherein said housing is elongate and the width of said housing is greater than the height of said housing.

31. The mechanism of claim 30, wherein said first plate members are elongate, said second plate members are elongate, and said first and second plate members extend longitudinally of said elongate housing.

32. A mechanism for supporting and permitting selected adjustment of a headrest relative to a chair back, the mechanism comprising an elongate support body, a headrest support bracket pivotally connected adjacent one end of said body, a back support bracket pivotally connected adjacent a second end of said body opposite said one end, a releasable locking mechanism operable in a locked position to hold said headrest support bracket, and back support brackets in selected adjusted positions relative to said body and upon release permitting pivotal adjustment of said headrest support bracket and back support brackets relative to said body, and a headrest positioning mechanism connected to said headrest support bracket in assembled operative condition permitting selected translation movement of said headrest relative to said headrest support bracket and toward and away from said chair back, said positioning mechanism comprising a connector member adapted to be secured to the rear side of a headrest, and said connector member and headrest support bracket having interengaging elements thereon permitting translational movement of said connector member relative to said headrest support bracket, said interengaging elements comprising at least one guide portion on one of said headrest support bracket and connector member, and the other of said headrest support bracket and connector member has at least one elongate guideway thereon, which receives and supports said guide portion for translational movement along a path defined by said guideway.

33. The mechanism of claim 32, wherein one of said headrest support bracket and said connector member has a pair of opposed spaced apart guide portions thereon, and the other of said headrest support bracket and connector member has a pair of elongate guideways thereon which receive and support said guide portions to permit translational movement of said connector member relative to said headrest bracket along a path defined by said guideways.

34. The mechanism of claim 33, wherein said guideways comprise a pair of elongate guide channels and said guide portions are configured to be slidably received in said channels.

35. The mechanism of claim 34, wherein said headrest support bracket comprises a guide plate having spaced apart opposed edge margin portions defining said guide portions and the connector member comprises a pair of guide rails defining guideway channels receiving said edge margin portions.

36. The mechanism of claim 32, which further comprises a layer of material of reduced frictional characteristic interposed between the interengaging elements of said headrest support bracket and said connector member to provide a selected sliding interconnection therebetween.

37. The mechanism of claim 36, wherein said material comprises DELRIN.

38. The mechanism of claim 32, wherein a friction element is coupled to one of said headrest support bracket and connector member and biasing means yieldably urges said friction element into contact with the other of said headrest support bracket and connector member to provide a selected frictional interconnection therebetween to retain said headrest support bracket and connector member in selected position when no operator force is being applied thereto.

39. A mechanism for supporting and permitting selected adjustment of a headrest relative to a chair back, the mechanism comprising a headrest support bracket adapted to be attached to the back of a chair, a connector member adapted to be attached to the rear side of a headrest cushion, and vertical positioning mechanism in assembled operative condition permitting selected translational movement of the connector member relative to said headrest support bracket comprising one of said headrest support bracket and said connector member having a guide plate with a pair of opposed spaced apart guide portions thereon and the other having a pair of guide rails defining elongate guide channels thereon which slidably receive and support said guide portions to permit translational movement of said connector member relative to said headrest support bracket along a path defined by said guide channels and a layer of material of reduced frictional characteristic is provided between said guide portions and guideways to provide a selected sliding interconnection therebetween.

40. The mechanism of claim 39, wherein a friction element is coupled to one of said headrest support bracket and connector member and biasing means yieldably urges said friction element into contact with the other of said headrest support bracket and connector member to provide a selected frictional interconnection therebetween to retain said headrest support bracket and connector member in selected position when no operator force is being applied thereto.

* * * * *

UNITED STATES PATENT AND TRADEMARK OFFICE

CERTIFICATE OF CORRECTION

PATENT NO. : 6,893,096 B2
DATED : May 17, 2005
INVENTOR(S) : Brian E. Bonn et al.

It is certified that error appears in the above-identified patent and that said Letters Patent is hereby corrected as shown below:

Column 11,
Line 45, delete “support bracket, and” and insert -- support bracket and --.
Line 52, delete “translation” and insert -- translational --.

Column 12,
Line 53, delete “channels” and insert -- channels, --.

Signed and Sealed this

Third Day of January, 2006

JON W. DUDAS
*Director of the United States Patent and Trademark Office*